United States Patent [19]

Underwood et al.

[11] Patent Number: 4,990,011

[45] Date of Patent: Feb. 5, 1991

[54] SHEET ALIGNMENT USING REVERSE ADVANCE ROLL AND STATIONARY PICK ROLL

[75] Inventors: John A. Underwood, Escondido; Anthony W. Ebersole, Poway; Todd R. Medin, Escondido, all of Calif.

[73] Assignee: Hewlett-Packard Company, Palo Alto, Calif.

[21] Appl. No.: 410,395

[22] Filed: Sep. 21, 1989

[51] Int. Cl.[5] ..... B41J 13/02

[52] U.S. Cl. ..... 400/636; 271/242; 271/902

[58] Field of Search ..... 400/624, 637.1, 636, 400/628, 629, 630; 271/242, 246, 902

[56] References Cited

U.S. PATENT DOCUMENTS

| | | | |
|---|---|---|---|
| 4,437,656 | 3/1984 | Onoda et al. | 271/242 |
| 4,721,297 | 1/1988 | Katayama | 271/242 |
| 4,779,861 | 10/1988 | Ozawa | 271/242 |

FOREIGN PATENT DOCUMENTS

| | | | |
|---|---|---|---|
| 0346220 | 12/1989 | European Pat. Off. | 271/242 |
| 2941816 | 5/1981 | Fed. Rep. of Germany | 400/637.1 |
| 3610900 | 10/1986 | Fed. Rep. of Germany | 271/242 |
| 0197332 | 9/1986 | Japan | 271/242 |
| 0259944 | 11/1987 | Japan | 271/242 |

*Primary Examiner*—Eugene H. Eickholt

[57] ABSTRACT

An automatic sheet feed alignment system is described for feeding sheets of print media such as paper to print mechanism in alignment with the print mechanism. A single motor drives a main sheet advance roller, and is also coupled to a sheet pick roller through a non-reversing clutch. An idler roller is disposed adjacent the drive roller. To feed a sheet into the print position, the motor drives the main drive roller and sheet pick roller in a sheet advancing direction, until the sheet leading edge is advanced into and past the nip between the main drive and idler rollers. The motor direction is then reversed so that the main roller retracts the sheet. Because the sheet pick roller is not driven in the reverse direction, a buckle is formed in the sheet between the sheet pick roller and the nip, tending to align the leading sheet edge with the nip. The motor direction is then reversed to drive the sheet forward to the print position, its leading edge having been aligned.

20 Claims, 4 Drawing Sheets

SHEET ALIGNMENT USING REVERSE ADVANCE ROLL AND STATIONARY PICK ROLL

BACKGROUND OF THE INVENTION

The present invention relates to the field of sheet paper feed apparatus for feeding sheets to a print mechanism, and more particularly to an apparatus which actively aligns a sheet of paper which has been fed out of a paper tray so that the skew of the sheet relative to a printer mechanism is significantly reduced.

Various active alignment systems have been employed in printer devices to align paper sheets relative to the printer mechanism. One type relies on gravity to achieve alignment. The disadvantage of such a system is that the orientation of the paper tray is necessarily constrained to particular orientations. Another system employs separate motors for the sheet pick up and paper advance mechanisms. The use of separate motors leads to additional cost and complexity.

Some sheet alignment systems use a clutch between the main paper advance mechanism and its motor, which could have a significant adverse effect on swath advance accuracy.

It is therefore an object of the present invention to provide a simple yet effective active alignment system for feeding sheets to a printer mechanism, which does not rely on gravity and does not affect the orientation of the paper tray.

A further object is to provide a sheet feed active alignment system which requires only one motor drive and yet does not require a clutch between the main paper advance mechanism and its motor.

SUMMARY OF THE INVENTION

An active sheet feed alignment system for feeding and aligning a sheet relative to a print mechanism is described. The system comprises a sheet pickup roller mounted for rotational movement and for contacting the outside sheet in a sheet tray. A main sheet advance roller is disposed in a sheet feed path between the tray and the print mechanism. A pinch roller is disposed adjacent the main roller so that a nip is defined between the main roller and the pinch roller, the sheet being received into the nip as it is advanced by the sheet pickup roller.

The system further comprises a motor drive system for selectively driving the main roller in either the clockwise or counter-clockwise direction, the motor being further coupled to the sheet pickup roller through a non-reversing clutch so that the sheet pickup and main rollers are driven in a predetermined one of the clockwise or counter-clockwise directions to feed sheets from the tray toward the printer mechanism, and when the main drive roller is driven in the opposite direction, the pickup roller is not driven.

A motor drive controller actuates the motor drive system to feed sheets seriatum to the printer mechanism in aligned positions. The controller comprises means for driving the pickup and main rollers in the predetermined direction so that the leading edge of the sheet is fed past the nip between the main and pinch rollers. The controller further comprises means for reversing the motor to drive the main roller in the reverse direction while the pickup roller is not driven and remains stationary, thereby forming a buckle in the sheet which tends to align the sheet leading edge with the nip. Means are provided for changing the motor drive direction to advance the sheet to the print position.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Overview of the Invention

Figure 1:
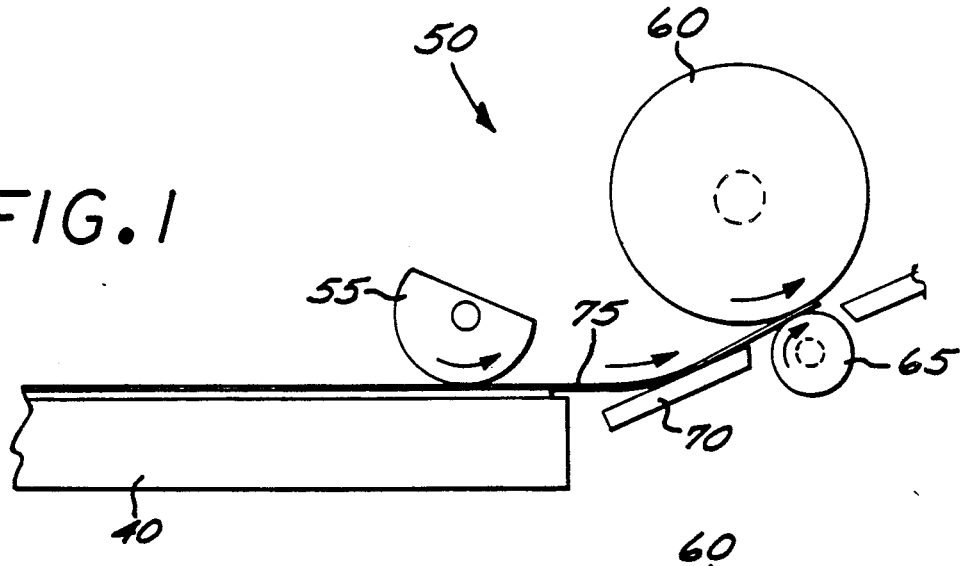
FIGS. 1–3 are simplified schematic diagrams illustrating the operation of the invention in the alignment of a sheet.
Figure 2:
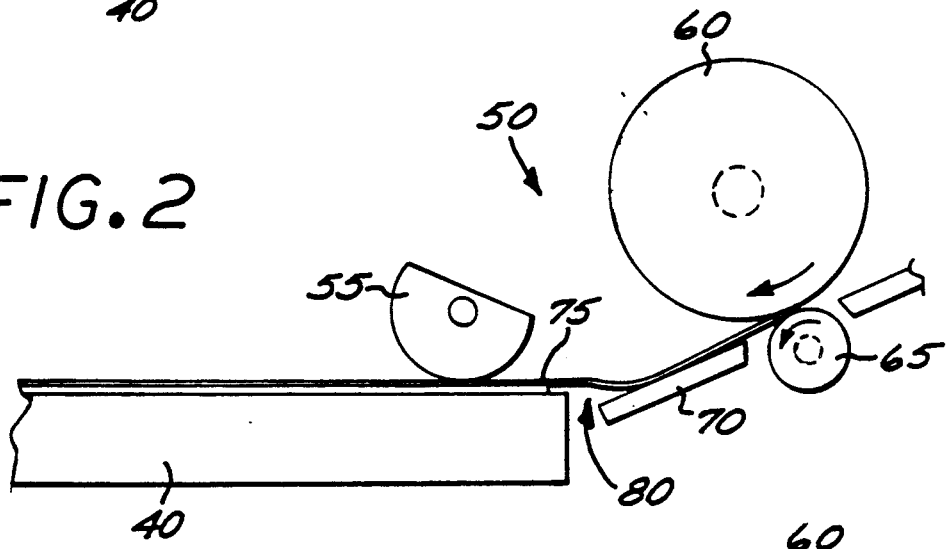
Figure 3:
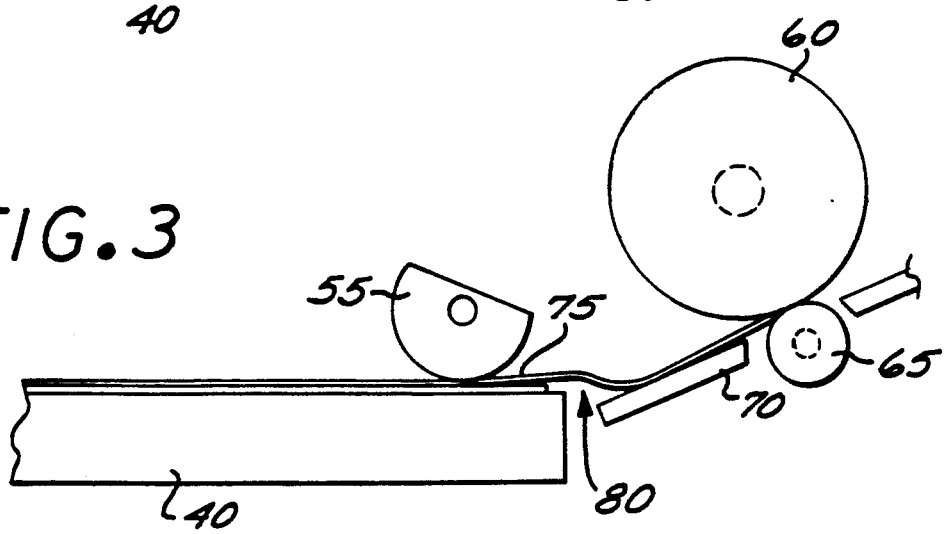

The operation of a sheet feed alignment system in accordance with the invention is disclosed in the simplified schematic diagrams of FIGS. 1–3. The system 50 is employed to sequentially feed sheet stock of a print media such as paper from a supply tray 40 to a print position. The elements of the system 50 include a D-shaped roller 55, a main sheet advance roller 60, a pinch roller 65, and a platform surface 70 for directing the sheets from the tray 40 into the nip between the pinch roller 65 and the main sheet advance roller 60. The main sheet advance roller and the sheet pick roller are arranged so that the distance between the respective rollers is less than the length of the sheet.

A single motor (not shown in FIGS. 1–3) is used to drive the sheet advance roller 60 and the sheet pick D roller 55. A non-reversing clutch (not shown in FIGS. 1–3) is used to couple the main drive to the D roller 55 so that the clutch will transmit motion in the forward direction (counter-clockwise) only; it slips when the motor reverses.

The alignment sequence commences when a sheet is picked by the rubber D roller 55. The D roller 55 pushes the sheet 75 into the nip between the main sheet advance roller and the pinch roller 65, until the entire leading edge of the sheet 75 has passed the nip (FIG. 1). At this point the D roller is still in contact with the sheet 75. Then the motor is reversed. The D roller 55 does not move because the clutch will not transmit reverse motion. The advance roller 60 and pinch roller 65 push the leading edge of the sheet 75 back into the nip, while the D roller prevents the rear of the sheet 75 from moving. Thus, a buckle 80 is created between the nip and the D roller 55 (FIGS. 2–3). This buckle tends to align the leading edge of the sheet 75 against the nip. Then the sheet 75 is advanced to the print position for the printing operation.

The Preferred Embodiment

Figure 4:
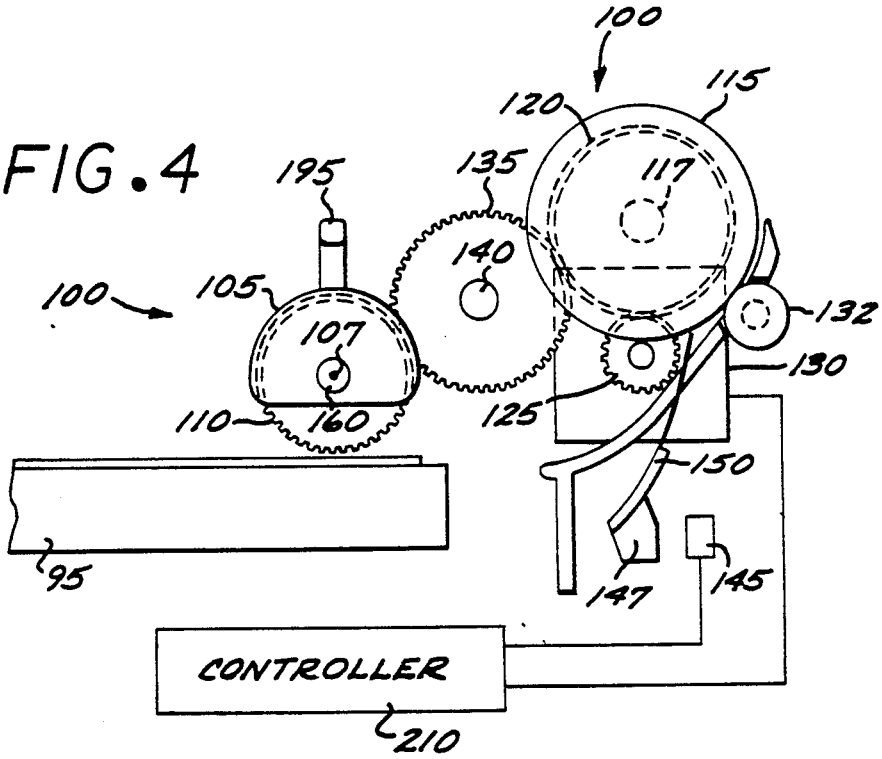
FIG. 4 is a simplified schematic diagram of a preferred embodiment of the invention.

FIG. 4 shows a preferred embodiment of a sheet feed active alignment system 100 embodying the invention. The system comprises a pair of separated D-shaped sheet pickoff rollers 105, preferably having a sheet contacting surface coated with rubber or similar material having a high coefficient of friction. The rollers 105 are mounted for rotation about an axis 107 on a common shaft 160, and are driven by a main clutch drive gear 110, also mounted for rotation about axis 107.

The main sheet advance roller 115 also has a circumferential surface coated with a material such as rubber, and is mounted for rotation on shaft 117. The main advance roller 115 is elongated with its sheet contacting surface area having a length preferably equal to or greater than the width dimension of the sheets. A drive roller gear 120 is secured to the drive roller 115 and is mounted for rotation on shaft 117. The drive gear 115 is further meshed with the motor pinion gear 125 of drive motor 130.

The system 100 further comprises an idler gear 135 mounted for rotation on shaft 140, and situated so that it meshes with the drive roller gear 120 and the main clutch drive gear 110.

The motor 130 is preferably a stepper motor controlled by a system controller 210. Thus, the motor 130 drives the drive roller 115 in a counter-clockwise, sheet advancing direction to advance the sheet from the tray 95. Driven by the idler gear 135, the D rollers 105 are driven in the counter-clockwise, sheet advancing direction as well, picking the sheet from the tray 95. Reversing the direction of the motor 130 causes the main roller 115 to rotate in the clockwise direction, but the drive force is not imparted to the D rollers 105 as a result of the clutch action, described more fully below.

The system further comprises an optical sensor 145 and a paper sensor lever 150 pivoting on pivot point 147. The lever 150 trips the optical sensor 145 when the leading edge of the sheet deflects the lever 150, providing a signal to the controller 140 used in control of the system.

Figure 5:
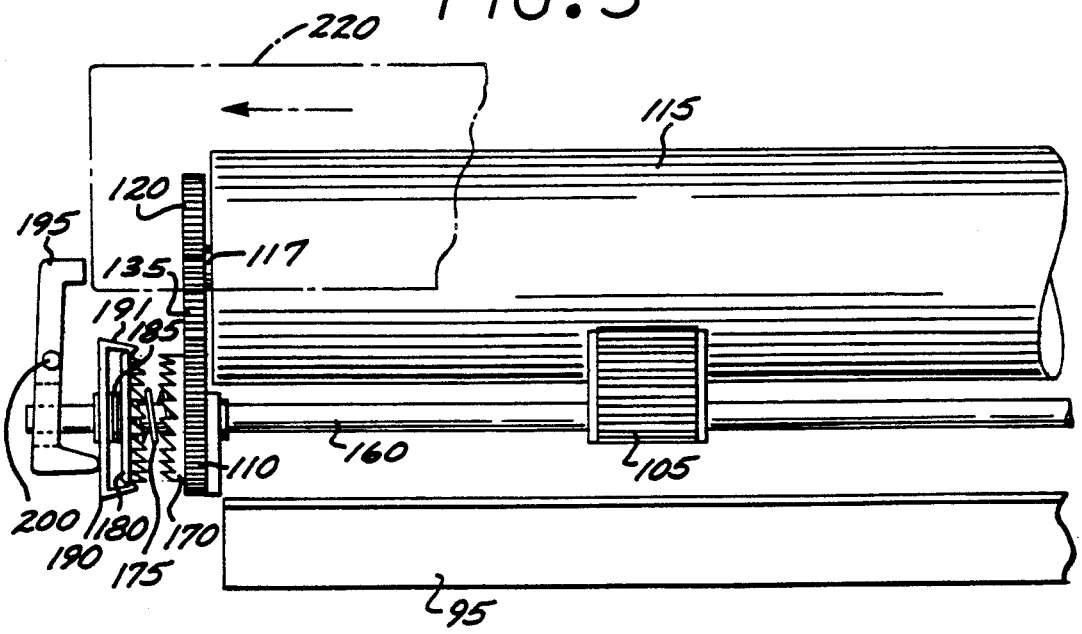
FIG. 5 is a partially broken-away plan view illustrating the main drive roller, the pick-up roller and the clutch coupling the main roller drive to the pick-up roller.

FIG. 5 illustrates in a broken-away plan view elements of the sheet feed alignment system of FIG. 4. The main sheet advance roller 115 is mounted on shaft 117. The D roller 105 is mounted on shaft 160. The drive gear 120 meshes with idler gear 135, which in turn meshes with the main clutch drive gear 110.

The D roller non-reversing clutch comprises the main drive half 170 and the main driven half 180, each mounted on shaft 160 and biased apart by the clutch release spring 175. The main driven half 180 is coupled to the spring clutch driven half 190 of the spring clutch by a square helical clutch spring 185, and by snaps 191 comprising the spring clutch driven half 190. The spring clutch driven half member 190 is keyed to the shaft 160, i.e, when the half member 190 rotates, the shaft 160 also rotates. The clutch drive half 170 and the main clutch drive gear 110 are free to rotate on shaft 160.

The clutch engagement lever 195 pivots on pivot axis 200. The pen carriage is mounted for sliding movement in the conventional manner on a pair of slider rods (not shown) directly above the main drive roller. The pen carriage carries the pen or print head and is driven along the slider rods to print a line or swath of data. The printing mechanism prints a swath or line of data along a printing axis or direction, which is substantially parallel to the axis on which the main sheet advance roller 115 rotates. The print media is advanced by the main drive roller to position the media to print the next line or swath. Other types of print and media advancement techniques may alternatively be employed with this invention. The pen carriage 195 is moved to an extreme left marginal position prior to the commencement of the printing of a sheet, thereby engaging the respective facing gear teeth of the clutch drive half 170 and the clutch driven half 180. In the engaged position, the D roller will be driven in one rotational direction; the clutch will not transmit drive force in the other direction.

Figure 6:
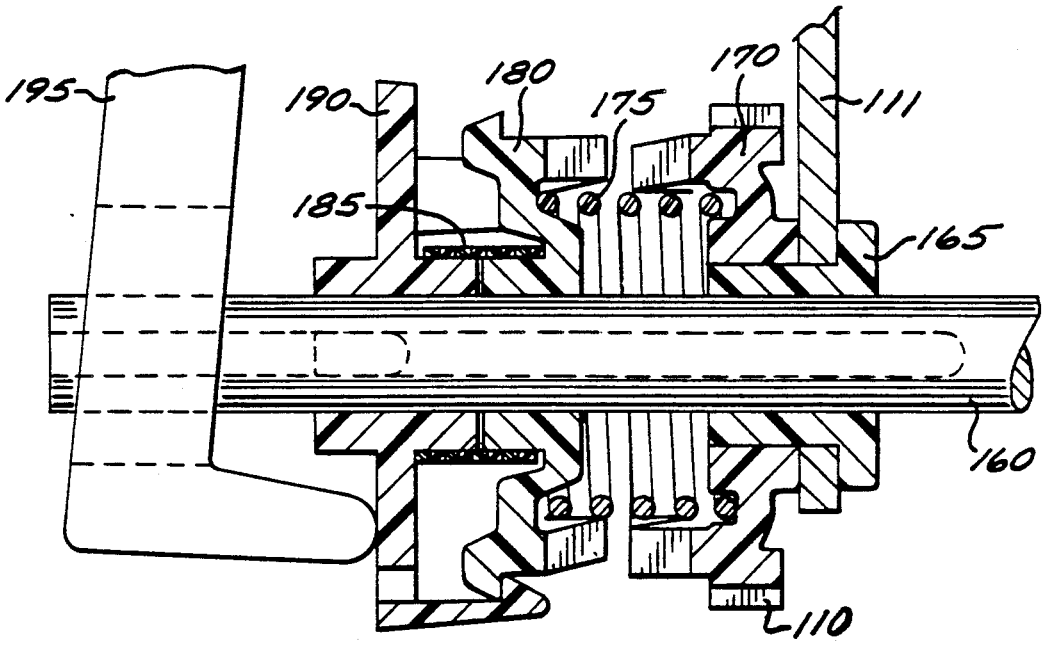
FIGS. 6 and 7 are cross-sectional views of the pick-up roller clutch in the respective disengaged and engaged positions.
Figure 7:
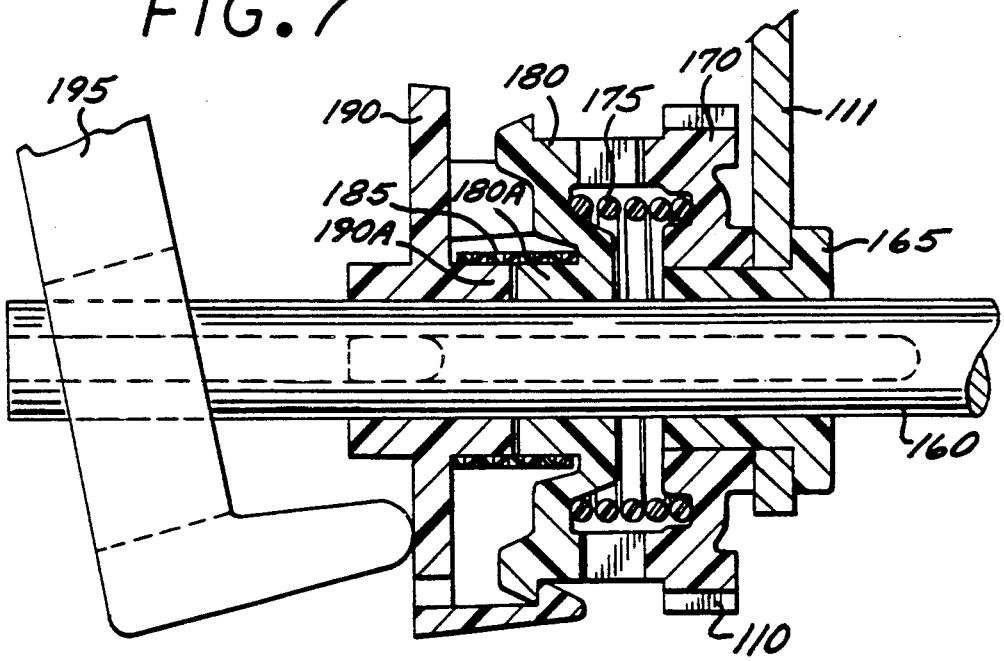

FIGS. 6 and 7 illustrates in schematic crosssectional view the non-reversing clutch in both the engaged and non-engaged positions. The clutch comprises a sideplate 111, main drive gear 110, bushing 165 and the main clutch drive half 170.

The main clutch driven half 180 is connected to the spring clutch driven half 190 by snaps 191, holding these elements together in the axial direction, but allowing them to rotate relative to one another.

The spring clutch 185 is a square wire helical spring which is fitted over respective hubs 180A and 190A comprising the main clutch driven half 180 and the spring clutch driven half 190, with some frictional interference. When the main clutch driven half 180 rotates in one direction, friction between the spring 175 and the hubs 180A and 190A causes the spring to tighten on the hubs. This locks the hubs 180A and 190A together so they turn together.

When the main clutch driven half 180 rotates in the other direction, the spring 175 loosens (unwinds) on the hubs 180A and 190A so that they do not lock and the main clutch driven half 180 and the spring clutch driven half 90 can rotate relative to one another.

The non-reversing clutch operates in the following manner. The main clutch drive gear 110 is continuously in mesh with the gear train, so that the clutch drive half 170 moves when the motor 130 moves. The drive half 170 with gear 110 rotates freely about bushing 165. Shaft 160 rotates freely within bushing 165, which is fixedly mounted in sideplate 111.

When the clutch is in the non-engaged position (FIG. 6), the clutch drive half 170 and the clutch driven half 180 are not engaged, and therefore no drive force in either direction can be imparted to the D rollers. Thus, while a sheet is being printed, advancement of the sheet by rotation of the main drive roller 115 does not result in any movement of the D roller. While a sheet is being printed, the D roller is preferably in the position shown in FIG. 4, with the roller flat side adjacent and parallel to the tray 95 so that the surface of roller 105 is not in engagement with the sheet, and does not impede its movement while being driven forward during the print operation.

When a sheet is to be fed, the pen carriage 220 pushes on the lever 195 to engage the clutch (FIG. 7). The stepper motor 130 turns in the forward direction. The lever 195 pushes elements 180, 185 and 190 so that the facing gear teeth of element 180 meshes with the corresponding facing gear teeth of the main clutch drive half 170. The pickoff shaft 160 turns, because motion is in the forward direction and the hubs 180A and 190A elements 180 and 190 are locked together by clutch spring 185.

The stepper motor 130 reverses for the active alignment sequence. The pickoff shaft 160 no longer moves, because element 190 slips relative to element 180. The stepper motor 130 moves forward again. The pickoff shaft 160 turns again and is released by the pen carriage 220. Element 190 continues to turn as a result of a detent drive, the turning D roller has made one full rotation, ending so that the D roller periphery is not in engagement with the sheet in the tray and the roller 105 flat side is substantially parallel with the paper tray. The detent drive (not shown) includes a dog protruding from the side of the spring clutch driven half 190 facing the lever 195. A housing plate (not shown) extends between the element 190 and lever 195, with the tip of the lever 195 extending through a hole formed in the housing. The dog formed on the side of element 190 normally is received in another hole formed in the housing. When the clutch is engaged by the lever 195, the element 190 is pushed away from the housing, freeing the dog and engaging gear elements 180 and 170. Element 190 rotates, moving the dog away from the corresponding opening in the housing plate. When the lever 195 releases, the dog bears on the housing plate, keeping the gear elements 180 and 170 in engagement and the element 190 and D roller rotating when the motor is turning in the forward direction, until the dog rotates to and drops into its corresponding opening formed in the housing plate. At this point, the gear elements 180 and 170 are released from engagement, and the D roller is correctly positioned with its flat side facing the sheet in the paper tray.

In a preferred embodiment, the clutch drive half 170, gear 110 and spring clutch driven half 190 are fabricated from a polyphenylene oxide material. The clutch driven half 180 is fabricated from a polycarbonate material. The hubs 180A and 190A have a nominal outer diameter dimension of 10.55 mm. The clutch spring comprises a stainless steel spring with left hand wind. The spring wire has a rectangular cross-section (0.635 by 0.38 mm) with a nominal 10.25 mm diameter.

Figure 8:
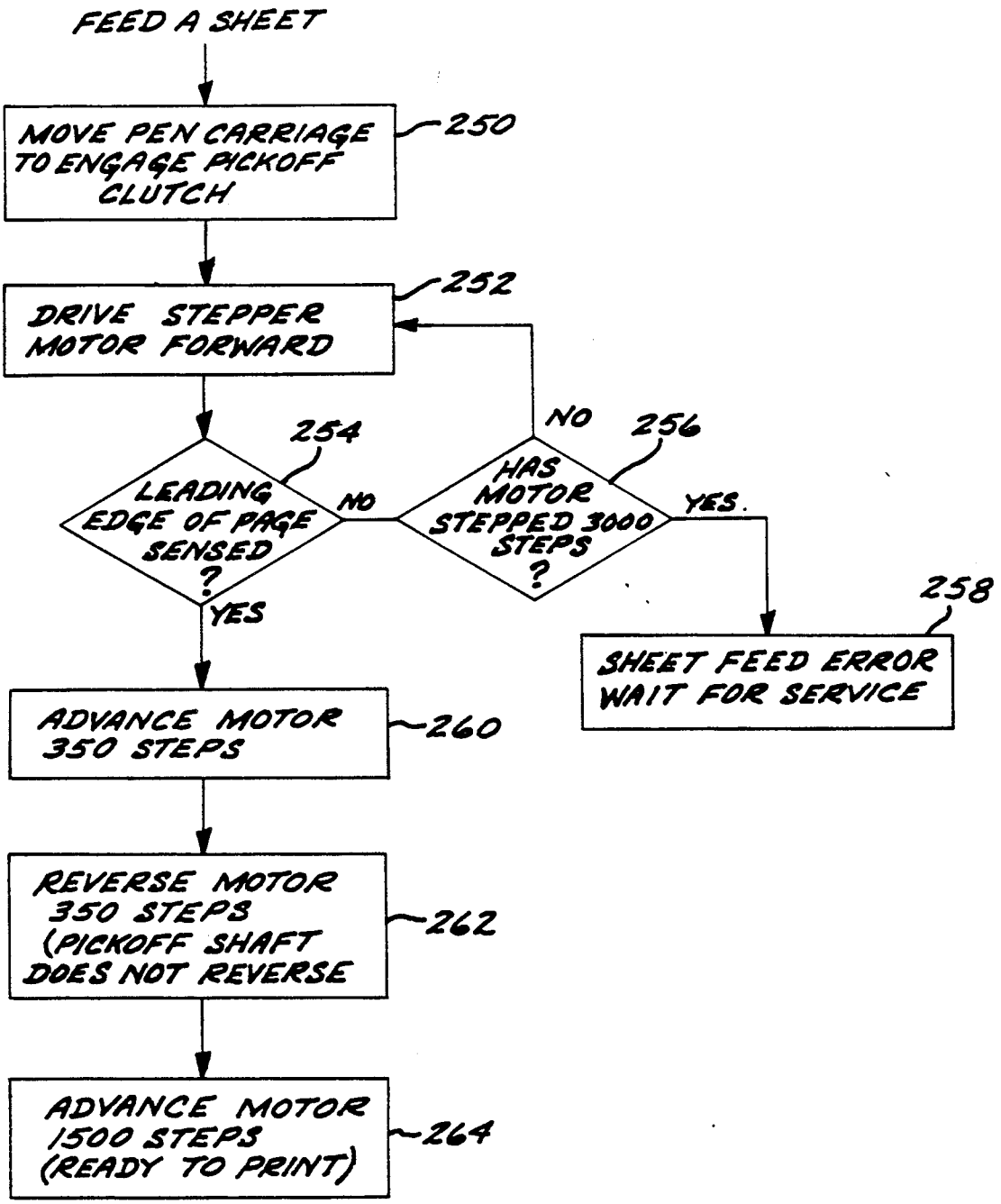
FIG. 8 is a simplified flow diagram illustrative of the operation of the sheet feed alignment system in accordance with the invention.

The flow diagram of FIG. 8 illustrates the sequence of steps taken to feed the sheet to the print position, including the active alignment of the sheet leading edge. At step 250, the pen carriage is moved to engage the pickoff clutch lever 195. The stepper motor 130 is then driven forward until the leading edge of the sheet is sensed by sensor 145, or until the motor has stepped through some predetermined number of steps, e.g., 3000 steps. If the motor has stepped through this number of steps (step 256) then a sheet feed error is declared and the system waits for service (step 258).

Once the leading edge of the sheet is sensed at step 254, then the motor 130 is advanced a predetermined number of steps (e.g., 350) so that the edge is advanced past the nip between the drive and pinch rollers 115 and 132 by a known distance. The motor 130 is then reversed by a similar number of steps, the pickoff shaft 160 not rotating during this motor reversal, in order to create the buckle in the sheet (step 262). The motor is then advanced a predetermined number of steps to bring the sheet to the print position (step 264).

There are three main advantages of this invention over previous active alignment systems (1) it does not rely on gravity and therefore does not affect the orientation of the paper tray, (2) it does not require separate motors for the sheet pick and paper advance mechanisms, and (3) it does not require a clutch between the main paper advance mechanism and its motor which could have a significant adverse effect on swath advance accuracy.

It is understood that the above-described embodiment is merely illustrative of the possible specific embodiments which may represent principles of the present invention. Other arrangements may readily be devised in accordance with these principles by those skilled in the art without departing from the scope of the invention.

What is claimed is:

1. In a printer system having a printer mechanism a sheet tray for storing a stack of print media sheets, and a sheet feed path extending between the sheet tray and the print mechanism, an active sheet alignment system for feeding and aligning a sheet relative to the printer mechanism, comprising:

a sheet pick roller mounted for axially rotational movement and for contacting a sheet in the tray;

a main sheet advance roller disposed in a sheet feed path between the tray and the print mechanism and arranged so that the distance between the sheet pick roller and the main sheet advance roller is less than the length of the sheet;

at least one pinch roller disposed adjacent said main roller, said main and pinch rollers being disposed to engagingly receive a sheet in the nip therebetween;

means for selectively driving said main roller in a sheet advancing or in a sheet retracting direction;

means for coupling said sheet pick roller to said motor drive means so that said sheet pick roller and said main roller are driven in the sheet advancing direction to feed a sheet from said tray toward said printer mechanism, and when the main roller is driven in the sheet retracting direction, the sheet pick roller is not driven and remains stationary; and means for controlling said drive means to feed sheets to the printer mechanism with the sheet leading edge aligned with the spring mechanism, comprising:

means for controlling said drive means to drive said sheet pick and main drive rollers in the sheet advancing direction so that the leading edge of the sheet is fed past the nip of the main and pinch rollers;

means for reversing the drive means, thereby driving the main roller in the sheet retracting direction while the sheet pick roller is stationary and does not move, thereby forming a buckle in the sheet which tends to align the sheet leading edge with the nip; and means for changing the motor drive direction to advance the sheet to the print position.

2. The system of claim 1 wherein said means for coupling said sheet pick roller to said drive means comprises a non-reversing clutch, comprising means for selectively transmitting only drive forces tending to rotate said sheet pick roller in said sheet advancing direction.

3. The system of claim 2 wherein said clutch means is operable in an engaged configuration to selectively transmit said drive forces tending to rotate said sheet pick roller in the sheet advancing direction, and in a nonengaged configuration wherein said clutch does not transmit drive forces to said sheet pick roller in either direction.

4. The system of claim 3 further comprising means for placing said clutch in the engaged position for feeding and aligning a sheet.

5. The system of claim 4 wherein said engaging means comprises a clutch engagement lever selectively actuated by said print mechanism to place the clutch in the engaged configuration.

6. The system of claim 5 wherein said print mechanism is positioned to an extreme marginal position to actuate said clutch engagement lever.

7. The system of claim 2 wherein said sheet pick roller is mounted on a first shaft for rotational movement, and wherein said clutch comprises a spring clutch driven half member having a first hub fixedly secured on said first shaft, a spring clutch drive half member mounted on said first shaft and having a second hub rotatable with respect to said first shaft, and a helical spring having a first end disposed over said first hub and a second end disposed over said second hub with some frictional interference, whereby when said drive half member is rotated in a first direction, said spring tightens on said respective hubs to cause said driven half member to be rotated, and when said drive half member rotates in the opposite direction, said spring loosens on said links so that no rotational force is imparted to said driven half member.

8. The system of claim 1 wherein said sheet pick roller comprises a D roller having a flat side.

9. The system of claim 1 wherein said sheet advance roller comprises an elongated roller arranged to rotate on an axis which is substantially parallel to the direction of printing by the printer mechanism.

10. In a printer system having a printer mechanism and a sheet tray and a sheet feed path extending between the sheet tray and the print mechanism, an active sheet alignment system for feeding and aligning a sheet relative to the printer mechanism, comprising:

a sheet pick roller mounted for axially rotational movement and for contacting the outside facing sheet in the tray;

a main sheet advance roller disposed in a sheet feed path between the tray and the print mechanism and arranged so that the distance between the sheet pick roller and the main sheet advance roller is less than the length of the sheet;

at least one pinch roller disposed adjacent said main roller, said main and pinch rollers being disposed to engagingly receive a sheet in the nip therebetween;

a motor drive system for selectively driving said main roller in a sheet advancing or in a sheet retracting direction, said system comprising a motor coupled to said main sheet advance roller;

means for coupling said sheet pick roller to said motor drive system so that said sheet pick roller and said main roller are driven together in the sheet advancing direction to feed a sheet from said tray toward said printer mechanism, and when the main roller is driven in the sheet retracting direction, the sheet pick roller is not driven and remains stationary; and a controller for controlling said motor drive system to feed sheets seriatum to the printer mechanism in aligned positions, comprising:

means for controlling said motor to drive said sheet pick and main drive rollers in said sheet advancing direction so that the leading edge of the sheet is fed past the nip of the main and pinch rollers;

means for reversing the motor, thereby driving the main roller in said other direction while the sheet pick roller is stationary and does not move, thereby forming a buckle in the sheet which tends to align the sheet leading edge with the nip; and means for changing the motor drive direction to rotate the main sheet advance roller and sheet pick roller to advance the sheet to the print position.

11. The system of claim 10 wherein said means for coupling said sheet pick roller to said motor drive system comprises a non-reversing clutch, comprising means for selectively transmitting only drive forces tending to rotate said sheet pick roller in said predetermined direction.

12. The system of claim 11 wherein said clutch means is operable in an engaged configuration to selectively transmit said drive forces tending to rotate said sheet pick roller in said predetermined direction, and in a nonengaged configuration wherein said clutch does not transmit drive forces to said sheet pick roller in either direction.

13. The system of claim 12 further comprising means for placing said clutch in the engaged position for feeding and aligning a sheet.

14. The system of claim 13 wherein said engaging means comprises a clutch engagement lever selectively actuated by said print mechanism to place the clutch in the engaged configuration.

15. The system of claim 14 wherein said print mechanism is positioned to an extreme marginal position to actuate said clutch engagement lever.

16. The system of claim 11 wherein said sheet pick roller is mounted on a first shaft for rotational movement, and wherein said clutch comprises a spring clutch driven half member having a first hub mounted on said first shaft and fixedly secured thereto with respect to rotational movement of the shaft and first hub, a spring clutch drive half member mounted on said first shaft and having a second hub rotatable with respect to said first shaft, and a helical spring having a first end disposed over said first hub and a second end disposed over said second hub with some frictional interference, whereby when said drive half member is rotated in a first direction, said spring tightens on said respective hubs to cause said driven half member to be rotated, and when said drive half member rotates in the opposite direction, said spring loosens on said links so that no rotational force is imparted to said driven half member.

17. The system of claim 10 wherein said sheet pick roller comprises a D roller having a flat side.

18. The system of claim 10 wherein said main sheet advance roller comprises an elongated roller arranged to rotate on an axis which is substantially parallel to the direction of printing by the printer mechanism.

19. In a printer system having a printer mechanism, a sheet tray for holding a plurality of print media sheets, a sheet pick roller for picking sheets from the tray, a main sheet advance roller and an idler roller disposed adjacent the main sheet advance roller, with the nip between the main and idler roller being disposed less than the length of a sheet from the sheet pick roller, a method for actively aligning the leading edge of the picked sheets with the print mechanism, comprising the steps of:

rotating the sheet pick roller and main advance roller in an advancing direction so as to pick a sheet from the sheet tray and advance it through the sheet feed path until the leading edge has been advanced past the nip between the main advance roller and the idles roller;

reversing the main advance roller to rotate in the sheet retracting direction with the sheet pick roller stationary to withdraw the leading edge of the sheet while the trailing portion of the sheet is held fixed by the stationary pick roller, thereby forming a buckle in the sheet which tends to align the sheet leading edge with the nip; and rotating the main roller and the sheet pick roller in the advancing direction to advance the sheet to the print position.

20. The method of claim 9 wherein said sheet pick roller comprises a generally D-shaped roller having a flat side normally disposed substantially parallel to the sheets held in the tray, and wherein said steps of rotating the sheet pick roller in the advancing direction results in the sheet pick roller being rotated through substantially one complete revolution.

* * * * *